US008326179B2

(12) United States Patent
Hashimoto

(10) Patent No.: US 8,326,179 B2
(45) Date of Patent: Dec. 4, 2012

(54) TANDEM TYPE PHOTOSENSITIVE UNIT AND IMAGE FORMING APPARATUS

(75) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 421 days.

(21) Appl. No.: 12/626,019

(22) Filed: Nov. 25, 2009

(65) Prior Publication Data

US 2010/0135697 A1 Jun. 3, 2010

(30) Foreign Application Priority Data

Nov. 28, 2008 (JP) ..... 2008-304940
Nov. 28, 2008 (JP) ..... 2008-304941

(51) Int. Cl.
*G03G 15/00* (2006.01)

(52) U.S. Cl. ..... 399/117

(58) Field of Classification Search ..... 399/116, 399/117

See application file for complete search history.

(56) References Cited

U.S. PATENT DOCUMENTS

| | | | | |
|---|---|---|---|---|
| 5,729,792 | A * | 3/1998 | Ikehara | 399/116 X |
| 6,198,891 | B1 * | 3/2001 | Ishida et al. | 399/117 |
| 6,785,489 | B2 * | 8/2004 | Anderson, II | 399/117 X |
| 7,020,410 | B2 * | 3/2006 | Zogg et al. | 399/117 X |
| 2003/0044198 | A1 | 3/2003 | Kato et al. | |
| 2003/0059229 | A1 | 3/2003 | Yamamoto et al. | |
| 2006/0140673 | A1 | 6/2006 | Kamimura et al. | |
| 2007/0036582 | A1 | 2/2007 | Okabe | |
| 2007/0110473 | A1 * | 5/2007 | Kondo et al. | 399/117 |
| 2007/0147885 | A1 * | 6/2007 | Okabe et al. | 399/111 |
| 2008/0181658 | A1 | 7/2008 | Okabe | |

FOREIGN PATENT DOCUMENTS

| | | | |
|---|---|---|---|
| JP | 2-165181 | A | 6/1990 |
| JP | 04-124271 | | 11/1992 |
| JP | 8-086338 | A | 4/1996 |
| JP | 10-104997 | A | 4/1998 |
| JP | 10-247039 | | 9/1998 |
| JP | 2001-255804 | A | 9/2001 |
| JP | 2003-071420 | A | 3/2003 |
| JP | 2006-184552 | A | 7/2006 |
| JP | 2006-313264 | A | 11/2006 |
| JP | 2007-072422 | | 3/2007 |
| JP | 2007-219266 | A | 8/2007 |
| JP | 2007-278428 | A | 10/2007 |
| JP | 2008-185830 | A | 8/2008 |

OTHER PUBLICATIONS

JP Office Action dtd Sep. 21, 2010, JP Appln. 2008-304940, English translation. JP Office Action dtd Sep. 21, 2010, JP Appln. 2008-304941, English translation.

* cited by examiner

*Primary Examiner* — Sandra Brase
(74) *Attorney, Agent, or Firm* — Banner & Witcoff, Ltd.

(57) ABSTRACT

A photosensitive unit includes: plural photosensitive drums; side plates provided on a first side and a second side of the photosensitive drums in an axial direction of the photosensitive drum, respectively, each of the side plates being formed with through holes at a position opposing each photosensitive drum in the axial direction; and plural bearing members fitted into the through holes, respectively, to support end portions of the photosensitive drums. An inner surface of each of the through holes has four linear portions. The four linear portions are in contact with a virtual circle virtually set in the corresponding through hole, and arranged at a regular angular interval with respect to a center of the virtual circle. Each of the bearing members includes an insertion portion which has an outer peripheral surface having a diameter larger than that of the virtual circle, and is inserted into the through hole.

19 Claims, 13 Drawing Sheets

TANDEM TYPE PHOTOSENSITIVE UNIT AND IMAGE FORMING APPARATUS

CROSS-REFERENCE TO RELATED APPLICATION

This application claims priority from Japanese Patent Application Nos. 2008-304940 and 2008-304941, filed on Nov. 28, 2008, the entire subject matter of which is incorporated herein by reference.

TECHNICAL FIELD

Aspects of the present invention relate to a tandem type photosensitive unit and an image forming apparatus including the photosensitive unit.

BACKGROUND

As an electrophotographic color printer, there is know a so-called tandem type color printer in which photosensitive drums corresponding to respective colors of yellow, magenta, cyan, and black are provided in parallel with each other. A color printer of this tandem type is configured such that four photosensitive drums are detachably mounted in a main body casing as a single unit.

This color printer includes drum subunits respectively holding the photosensitive drums, and a pair of side plates supporting the drum subunits from both sides in a width direction of the photosensitive drums. A developing cartridge including developing roller is detachably mounted between the side plates so as to correspond to each churn subunit. The drum subunits, the developing cartridges, and the pair of side plates are detachably mounted in the main body casing as a drum unit.

Both end portions of a drum shaft of each of the photosensitive drums protrude outward from both side surfaces of the corresponding drum subunit. Each side plate is formed with four axial holes at a regular interval in the arrangement direction of the photosensitive drums. The end portions of the drum shaft are respectively inserted into the axial holes, and each end portion of the drum shaft is pressed by a wire spring to an inner surface of the axial hole so as to position the drum shaft (photosensitive drum).

In the above-described color printer, if stress is applied to the photosensitive drum, the drum shaft could be deviated against an urging force of the wire spring. As a result, positioning precision of the photosensitive drums deteriorates, so that quality of an image formed by the photosensitive drums becomes worse.

Further, if the surfaces of the photosensitive drums are damaged or foreign matter adheres thereto, the images formed on the sheet are disordered. Therefore, if the surface of any photosensitive drum is damaged or foreign matter adheres thereto in the assembly or use of the color printer, the photosensitive drum is required to be replaced.

However, in the above-described color printer, both end portions of the drum shaft of each of the photosensitive drums are inserted into the pair of side plates. If one of the photosensitive drums needs to be replaced after the drum unit is assembled, the photosensitive drum cannot be independently removed from between the pair of side plates. That is, the pair of side plates has to be detached from all the drum subunits to remove the drum subunits therefrom. Therefore, it takes a lot of time to replace the photosensitive drum. Then, after the photosensitive drum is replaced, one side plate has to be attached to the four drum subunits, so it takes a lot of time to reassemble the color printer.

SUMMARY

Accordingly, it is an aspect of the present invention to provide a tandem type photosensitive unit allowing precise positioning of a photosensitive drum and an image forming apparatus including the photosensitive unit.

Further, it is another aspect of the present invention to provide a tandem type photosensitive unit allowing easy replacement of a photosensitive drum and an image forming apparatus including the photosensitive unit.

According to an exemplary embodiment of the present invention, there is provided a tandem type photosensitive unit comprising: a plurality of photosensitive drums provided in parallel with each other; first and second side plates provided on a first side and a second side of the photosensitive drums in an axial direction of the photosensitive drum, respectively, so as to oppose with each other, the first side plate being formed with a first through hole at a position opposing each photosensitive drum in the axial direction, the second side plate being formed with a second through hole at a position opposing each photosensitive drum in the axial direction; a first bearing member fitted into each of the first through holes and supporting a first end portion of the corresponding photosensitive drum at the first side; and a second bearing member fitted into each of the second through holes and supporting a second end portion of the corresponding photosensitive drum at the second side. An inner surface of each of the through holes has four linear portions. The four linear portions are in contact with a virtual circle virtually set in the corresponding through hole, and arranged at a regular angular interval with respect to a center of the virtual circle. Each of the first and second bearing members includes an insertion portion which has an outer peripheral surface having a diameter larger than that of the virtual circle, and is inserted into the corresponding through hole.

According to another exemplary embodiment of the present invention, there is provided an image forming apparatus comprising: an apparatus main body; and the tandem type photosensitive unit detachably mounted in the apparatus main body.

According to a further exemplary embodiment of the present invention, there is provided a tandem type photosensitive unit comprising: a plurality of photosensitive drums provided in parallel with each other; a shaft provided on a central axis of each of the photosensitive drums; a first side plate provided on a first side of the photosensitive drums in an axial direction of the photosensitive drum, the first side plate being formed with a first through hole at a position opposing each photosensitive drum in the axial direction; a second side plate provided on a second side of the photosensitive drum in the axial direction so as to oppose the first side plate, the second side plate being formed with a second through hole at a position opposing each photosensitive drum in the axial direction; a first bearing member fitted into the first through hole; and a second bearing member fitted into the second through hole. Each of the photosensitive drums includes: a cylindrical drum main body; a flange member engaged with an end portion of the drum main body at the first side; and an earth member provided in the drum main body. The shaft passes through the flange member, such that a first end portion of the shaft at the first side protrudes from the flange member toward the first side, and a second end portion of the shaft at the second side comes into contact with the earth member.

The first bearing member includes: a shaft support portion which supports the first end portion of the shaft; a flange support portion which supports the flange member; and a first flange portion which comes into contact with an inner side surface of the first side plate. The second bearing member includes: a second side support portion which supports a second end portion of the photosensitive drum at the second side; and a second flange portion which comes into contact with an outer side surface of the second side plate.

According to a further exemplary embodiment of the present invention, there is provided an image forming apparatus comprising: an apparatus main body; and the tandem type photosensitive unit detachably mounted in the apparatus main body.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, embodiments of the present invention will be described in detail with reference to the accompanying drawings.

1. Printer

Figure 1:
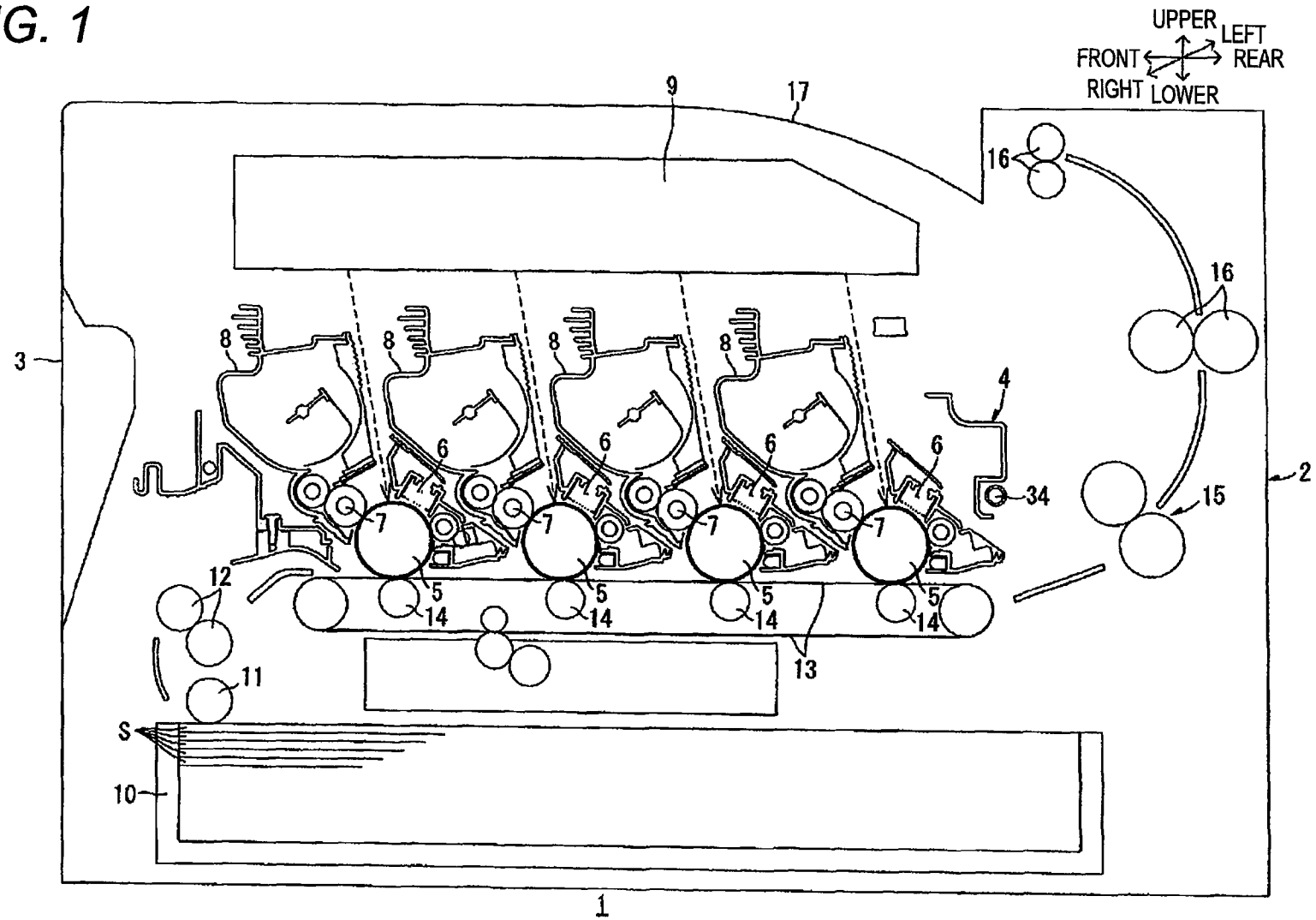
FIG. 1 is a side sectional view of an embodiment of a printer which is an example of an image forming apparatus according to the present invention.

A printer 1 is shown in FIG. 1 as an example of an image forming apparatus according to an embodiment of the preset invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as the width direction, and the upper-lower direction is also referred to as the vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is a tandem type color printer. The printer 1 includes a main body casing 2 (an example of an apparatus main body). A front cover 3 is provided on one side surface of the main body casing 2 so as to be openable/closable.

A drum unit 4 (an example of a tandem type photosensitive unit) is provided in the main body casing 2. The drum unit 4 is mountable in and removable from the main body casing 2 through a mounting port formed on the front surface of the main body casing 2 while the front cover 3 is opened.

The drum unit 4 includes four photosensitive drums 5 which are provided in parallel each other and arranged in the front-rear direction so as to be rotatable. A scorotron-type charger 6 and a developing roller 7 are provided in each photosensitive drum 5 so as to oppose each other. A developing cartridge 8, which holds the developing roller 7 and accommodating toner (developer), is provided adjacent to each of the photosensitive drums 5. The developing cartridge 8 is detachably mounted on the drum unit 4. Toner of the developing cartridge 8 is carried on the surface of the developing roller 7.

The surface of each photosensitive drum 5 is uniformly charged by the charger 6 and then exposed by a laser beam (see a broken-line arrow) emitted from a scanner unit 9 provided at the upper portion of the main body casing 2. Thus, an electrostatic latent image based on image data is formed on the surface of each photosensitive drum 5. The electrostatic latent image of each photosensitive drum 5 is made visible by toner carried on the surface of the developing roller 7 corresponding to each photosensitive drum 5, so that a toner image is formed on the surface of each photosensitive drum 5. The colors of toner accommodated in the developing cartridges differ according to the developing cartridges 8. Therefore, the colors of the toner images of the photosensitive drums 5 differ according to the photosensitive drums 5.

A sheet feed cassette 10 in which sheets S are stacked in the upper-lower direction is provided on the bottom portion of the main body casing 2. The uppermost sheet S of the sheet S accommodated in the sheet feed cassette 10 is fed out to the front side by a sheet feed roller 11 which is provided so as to oppose the front end portion of the sheet feed cassette 10 from above. The fed sheet S is transported upwardly while changing direction from the front side to the rear side.

Then, the sheet S enters between a pair of registration rollers 12. The pair of registration rollers 12 sends the sheet S toward a transport belt 13 provided on the rear side, at a predetermined timing.

The transport belt 13 is an endless type, and four transfer rollers 14 are provided inside the transport belt 13. The four transfer rollers 14 are provided in parallel in the front-rear direction, and each transfer roller 14 opposes the corresponding photosensitive drum 5 from below with the upper portion of the transport belt 13 interposed therebetween.

The sheet S sent from the pair of registration rollers 12 is transported to the upper portion of the transport belt 13. The transport belt 13 is rotated in a clockwise direction of FIG. 1 so as to transport the sheet S on the upper portion to the rear side. The toner images on the surfaces of the respective photosensitive drums 5 are transferred onto the sheet S transported by the transport belt 13 by a transfer bias applied to the transfer rollers 14 and then sequentially superimposed. The colors of the toner images of the respective photosensitive drums 5 differ according to the photosensitive drums 5. The toner images of four colors are superimposed on the sheet S, so that a color image is formed on the sheet S.

The sheet S on which a color image is formed is transported to a fixing part 15, which is provided on the rear side, by the transport belt 13. The toner images of the photosensitive drums 5 transferred to the sheet S are thermally fixed by the fixing part 15. Thereafter, the sheet S is transported by transport rollers 16 upwardly while changing direction from the rear side to the front side, and is discharged to a sheet discharge tray 17 provided at the upper portion of the main body casing 2.

2. Drum Unit

Figure 2:
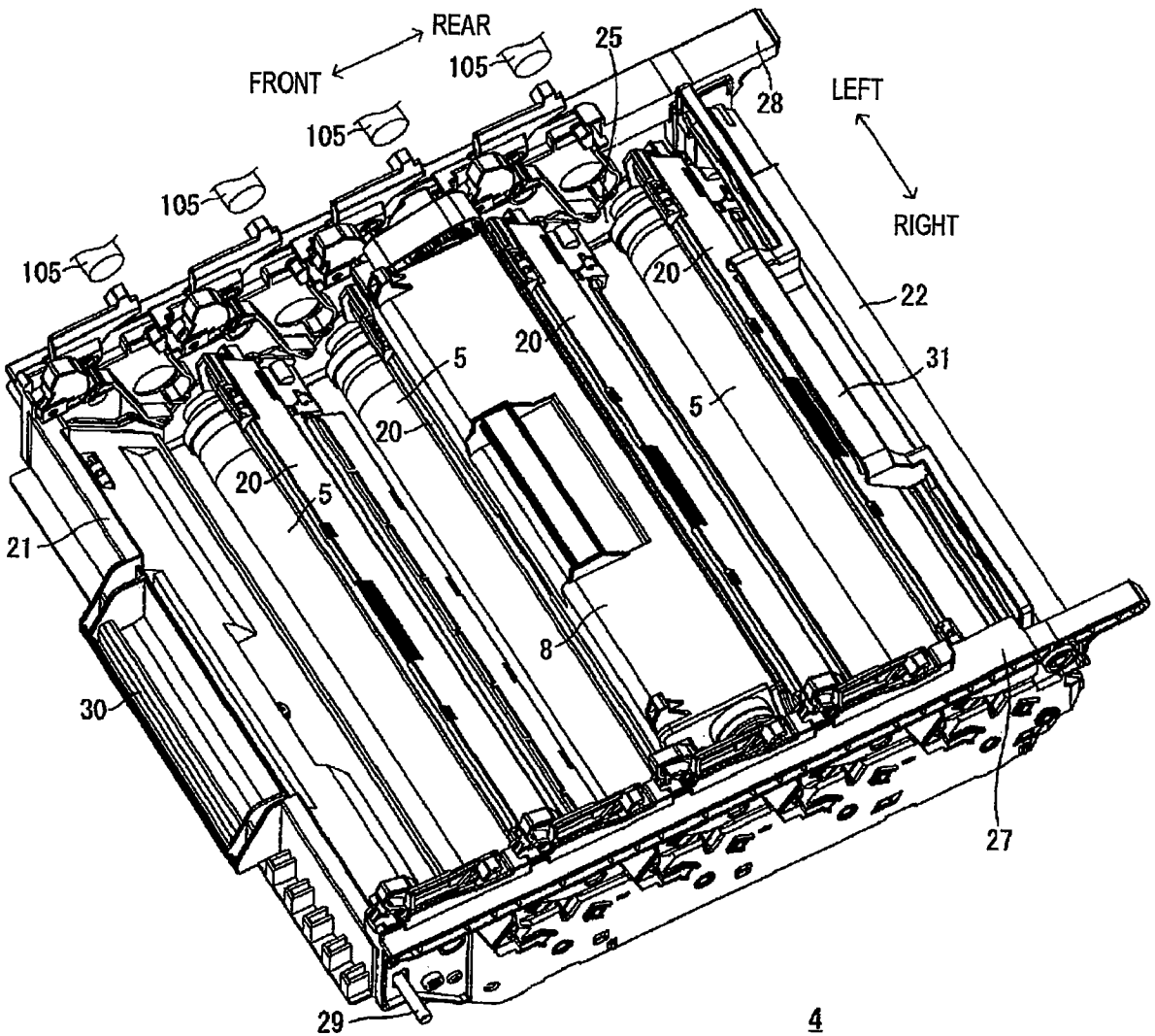
FIG. 2 is a perspective view of a drum unit when viewed from above the right front side, wherein one of the developing cartridges is mounted and the remaining developing cartridges are not mounted.

As shown in FIG. 2, the drum unit 4 includes, as a single unit, the four photosensitive drums 5, the four developing cartridges 8, the four drum subunits 20, a front beam 21, a rear beam 22, first inner side plates 24 and a second inner side plate 25 (an example of a pair of a first side plate and a second side plate), and a pair of a first outer side plate 27 and a second outer side plate 28. The drum unit 4 is slidably mountable in and detachable from the main body casing 2 (see FIG. 1).

(1) Drum Subunit

The four drum subunits 20 are provided at an interval in the front-rear direction between the first inner side plate 24 and the second inner side plate 25. Each drum subunit 20 is made of resin and has a substantially triangular prism elongated in the width direction and opened toward a front lower side. Each drum subunit 20 holds the charger 6 shown in FIG. 1 and a cleaning member (not shown) for cleaning the surface of the corresponding photosensitive drum 5.

(2) Front Beam

The front beam 21 is made of resin. The front beam 21 is provided between the front end portions of the pair of first inner side plate 24 and second inner side plate 25.

The front beam 21 holds a support shaft 29. The support shaft 29 is provided so as to pass through the front beam 21 in the width direction, and protrudes from the front beam 21 outward in the width direction. Further, the support shaft 29 passes through the first inner side plates 24, the second inner side plate 25, the first outer side plate 27, and the second outer side plate 28 and protrudes outward in the width direction.

A front grip portion 30 is formed integrally at a central portion in the width direction on the front surface of the front beam 21. The front grip portion 30 is substantially U-shaped in plan view. The free end portions of the front grip portion 30 are connected to the front beam 21.

(3) Rear Beam

The rear beam 22 is made of resin. The rear beam 22 is provided between the rear end portions of the pair of first inner side plate 24 and second inner side plate 25.

A rear grip portion 31 is formed integrally at a central portion in the width direction on the upper surface of the rear beam 22. The rear grip portion 31 is substantially U-shaped in rear view. The free and portions of the rear grip portion 31 are connected to the rear beam 22, such that the rear grip portion 31 is provided so as to be inclined from a rear lower side to a front upper side and to protrude obliquely upward from the rear beam 22.

(4) Inner Side Plate

The first inner side plate 24 provided on the right side and the second inner side plate 25 provided on the left side are formed by press-working metal plates with using the same press die. Accordingly, the first inner side plate 24 and the second inner side plate 25 have the same shape. Hereinafter, the configuration of the second inner side plate 25 will be described.

Figure 3:
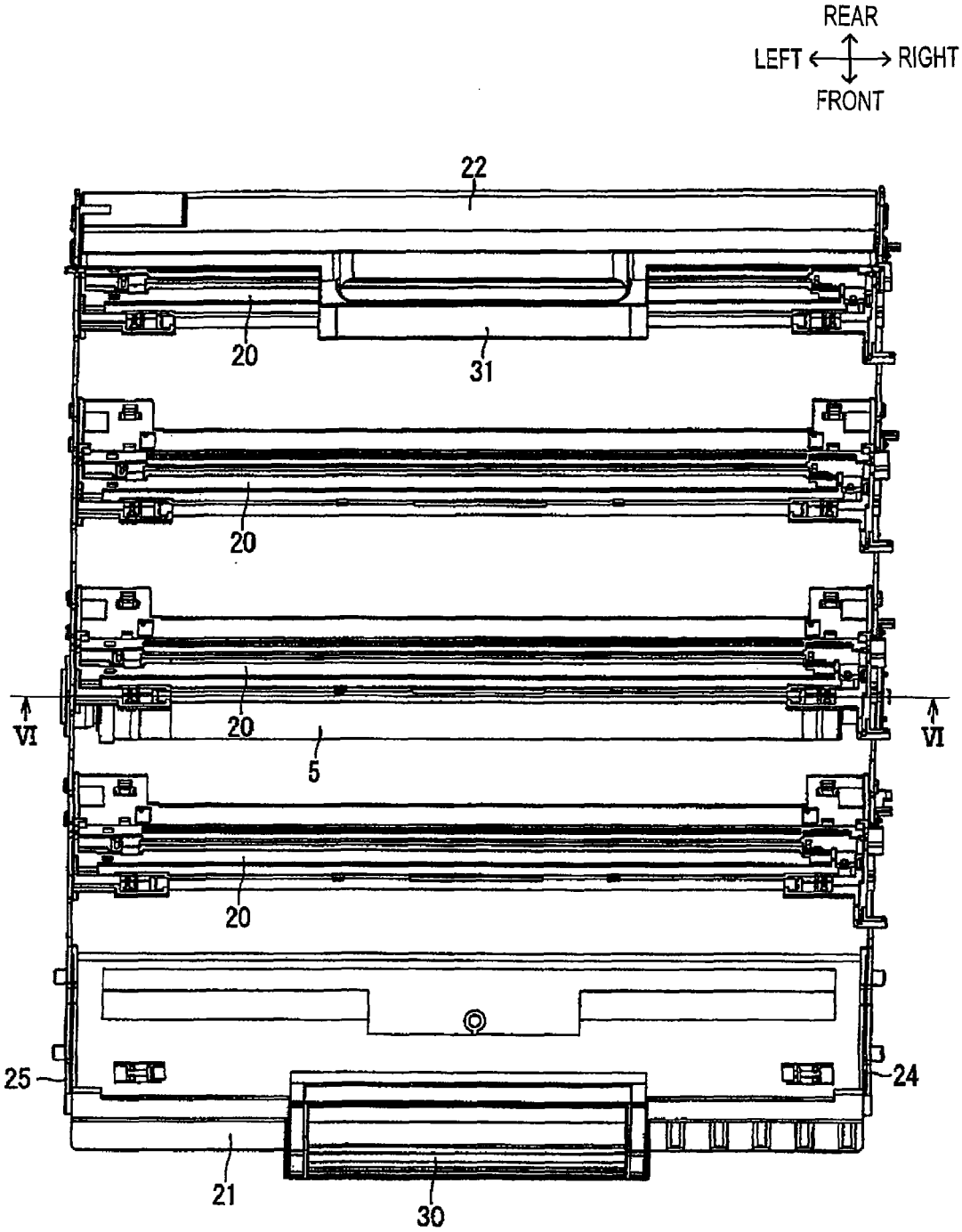
FIG. 3 is a plan view of the drum unit, wherein a pair of outer side plates is removed.
Figure 4:
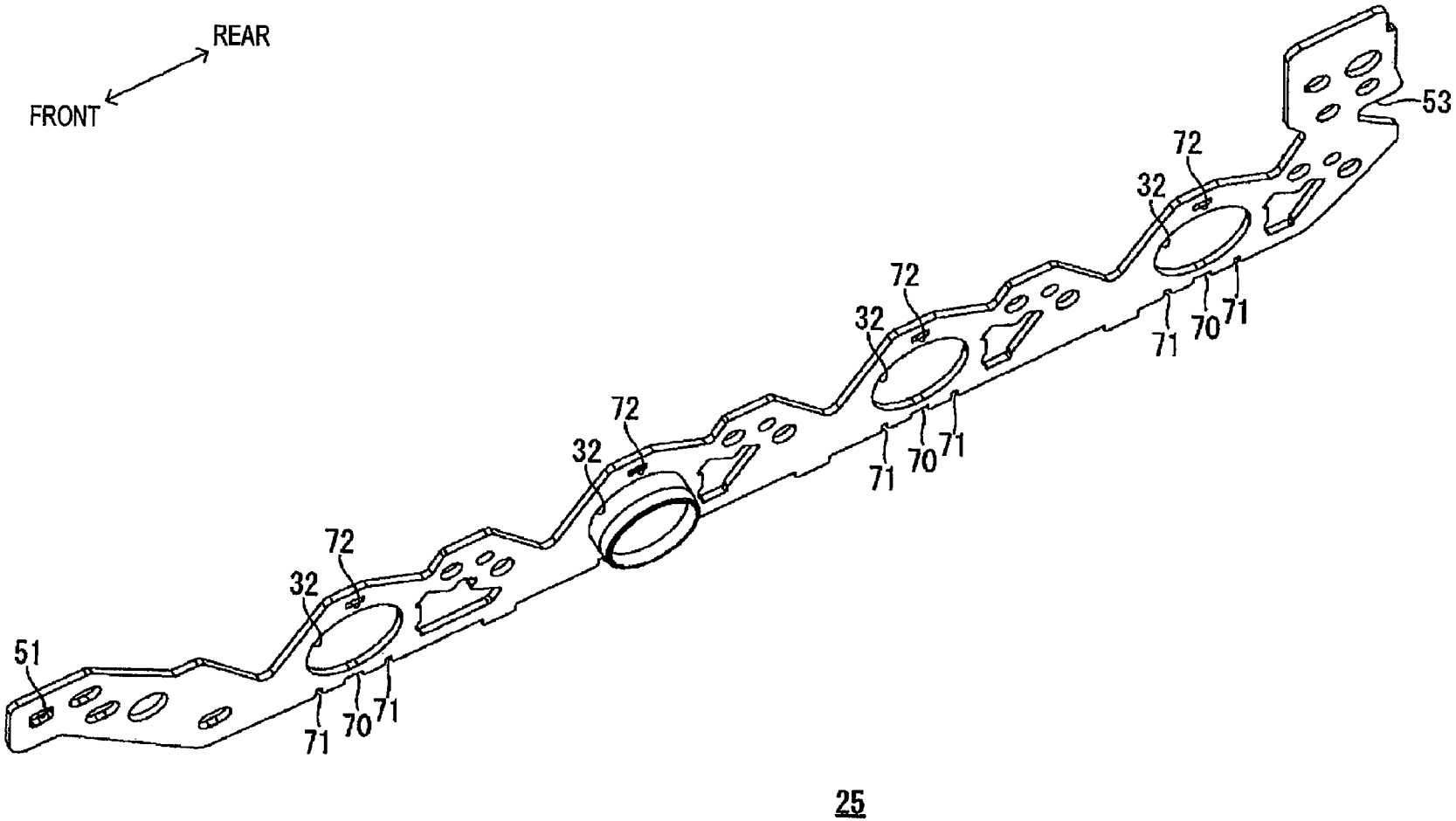
FIG. 4 is a perspective view of a second inner side plate when viewed from above the right front side.

As shown in FIGS. 3 and 4, the second inner side plate 25 has a substantially elongated rectangular plate extending in the front-rear direction. The front end portion and the rear end portion of the second inner side plate 25 oppose the front beam 21 and the rear beam 22, respectively, in the left-right direction.

The front end portion of the second inner side plate 25 extends toward the front upper side. A support shaft insertion hole 51 into which the support shaft 29 is inserted is formed at the front end portion of the second inner side plate 25.

The rear end portion of the second inner side plate 25 is substantially L-shaped in side view. Specifically, the rear end portion of the second inner side plate 25 is formed so as to be inclined toward a rear upper side and extended upward.

A notched portion 53 (an example of positioning portion) is formed at the rear end portion of the second inner side plate 25 by notching the lower edge of the notched portion 53 into a substantially V-shape. Specifically, the notched portion 53 has an upper edge extending in the front-rear direction in side view, a lower edge inclined toward a front upper side with a constant gradient, and a front edge connecting the front end of the upper edge and the front end of the lower edge. As shown in FIG. 1, the notched portion 53 receives a main body reference shaft 34 which is provided on the rear side of the main body casing 2 to extend in the width direction in a state where the drum unit 4 is mounted in the main body casing 2, and comes into contact with the main body reference shaft 34 from the upper and front sides.

(4-1) Drum Support Hole

The second inner side plate 25 is formed with drum support holes 32 (an example of first and second through holes or through hole). The drum support holes 32 are formed between the front end portion and the rear end portion of the second inner side plate 25 at a regular interval in the front-rear direction.

Figure 5:
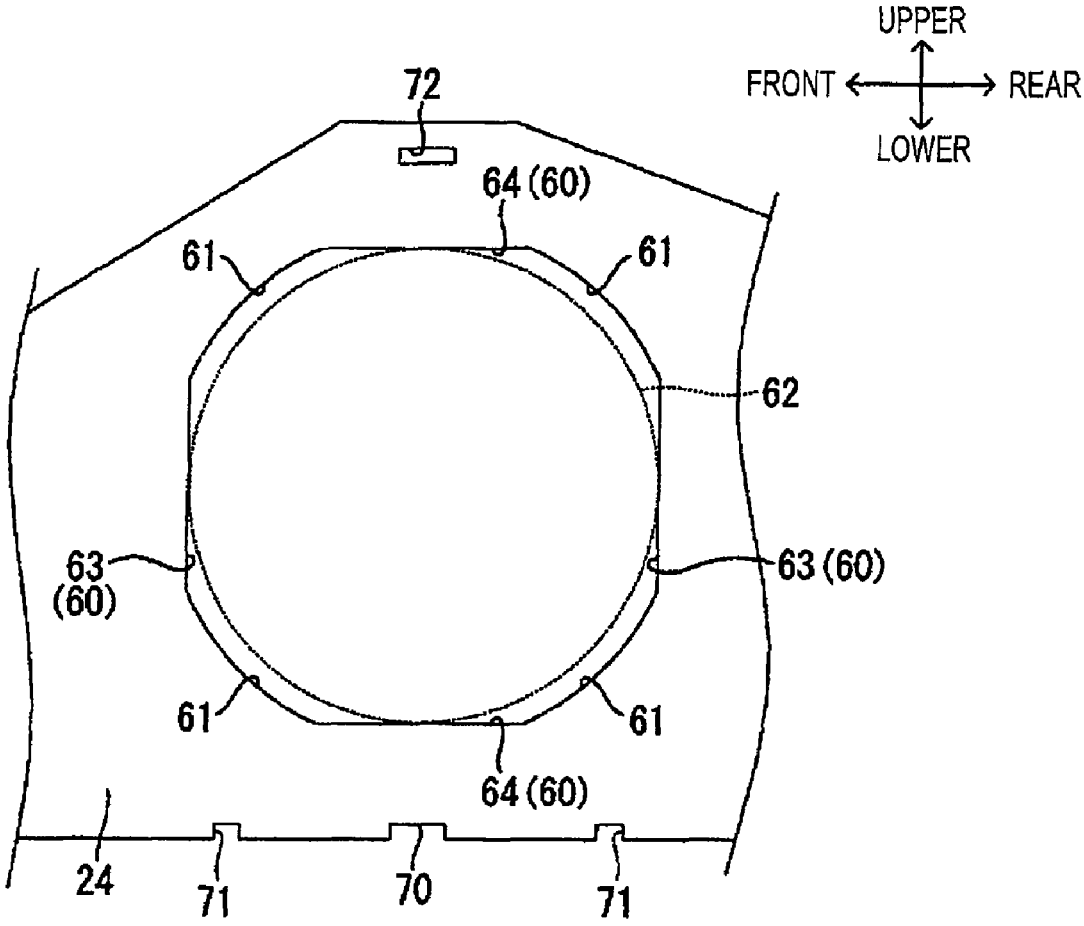
FIG. 5 is an enlarged view of a portion around a drum support hole of the inner side plate.

As shown in FIG. 5, the inner surface of each of the drum support holes 32 has four linear portions 60 and four curved portions 61.

The four linear portions 60 are in contact with a virtual circle 62 (indicated by a broken line in FIG. 5) virtually set in the drum support hole 32 and arranged at a regular angular interval with respect to the center of the virtual circle 62. Specifically, the four linear portions 60 include two vertical linear portions 63 and two horizontal linear portions 64. The two vertical linear portions 63 extend in the upper-lower direction and oppose each other in the front-rear direction. The two horizontal linear portions 64 extend in the front-rear direction and oppose each other in the upper-lower direction.

The four curved portions 61 each connect two linear portions 60 orthogonal to each other, and are formed so as to be swollen outward in the radial (diameter) direction of the virtual circle 62. Thus, the drum support hole 32 has a substantially rectangular shape with rounded apexes, in side view.

The drum support holes 32 are formed by punching out the first inner side plate 24 and the second inner side plate 25 from the left sides. Therefore, a portion around the drum support hole 32 at the inner side surface of the first inner side plate 24 and a portion around the drum support hole 32 at the outer side surface of the second inner side plate 25 have so-called sag surfaces. A portion around the drum support hole 32 at the outer side surface of the first inner side plate 24 and a portion around the drum support hole 32 at the inner side surface of the second inner side plate 25 have so-called burr surfaces.

(4-2) Engagement Groove

The second inner side plate 25 is formed with a first bearing engagement groove 70 and clip engagement grooves 71 at the lower edge thereof and at positions below each drum support hole 32.

The first bearing engagement groove 70 is formed at a position overlapping the center of the drum support hole 32 in the upper-lower direction by notching the second inner side plate 25 in a substantially rectangular shape from the lower edge.

The clip engagement grooves 71 are formed at positions in front of and at the rear of the bearing engagement groove 70 by notching the second inner side plate 25 from the lower edge.

Further, the second inner side plate 25 is formed with a second bearing engagement hole 72 at a position above each drum support hole 32. The second bearing engagement hole 72 is formed at a position point-symmetric to the first bearing engagement groove 70 with respect to the center of the drum support hole 32 and has an angular hole passing through the second inner side plate 25.

(5) Outer Side Plate

As shown in FIG. 2, the pair of first outer side plate 27 and second outer side plate 28 are made of, for example, fiber-reinforced resin. The first outer side plate 27 and the second outer side plate 28 have a substantially elongated rectangular shape in side view, which is wider in the upper-lower direction than and substantially identical in length in the front-rear direction to the first inner side plate 24 and the second inner side plate 25. The front end portions and the rear end portions of the first outer side plate 27 and the second outer side plate 28 oppose the front beam 21 and the rear beam 22, respectively, in the left-right direction.

The front end portions of the first outer side plate 27 and the second outer side plate 28 are formed narrower in the upper-lower direction than the intermediate portions of the first outer side plate 27 and the second outer side plate 28. The lower edges of the front end portions of the first outer side plate 27 and the second outer side plate 28 are inclined toward a front upper side. The rear end portions of the first outer side plate 27 and the second outer side plate 28 are formed narrower in the upper-lower direction than the intermediate portions of the first outer side plate 27 and the second outer side plate 28. The lower edges of the rear end portions of the first outer side plate 27 and the second outer side plate 28 are inclined toward a rear upper side.

At the rear end portions of the first outer side plate 27 and the second outer side plate 28, notched portions 33 are respectively formed at positions opposing the notched portions 53 (see FIG. 4) of the first inner side plate 24 and the second inner side plate 25 in the width direction to have the substantially same shapes as the notched portions 53. The notched portions 33 do not interfere with the main body reference shaft 34 in a state where the drum unit 4 is mounted in the main body casing 2.

(6) Photosensitive Drum

Figure 6:
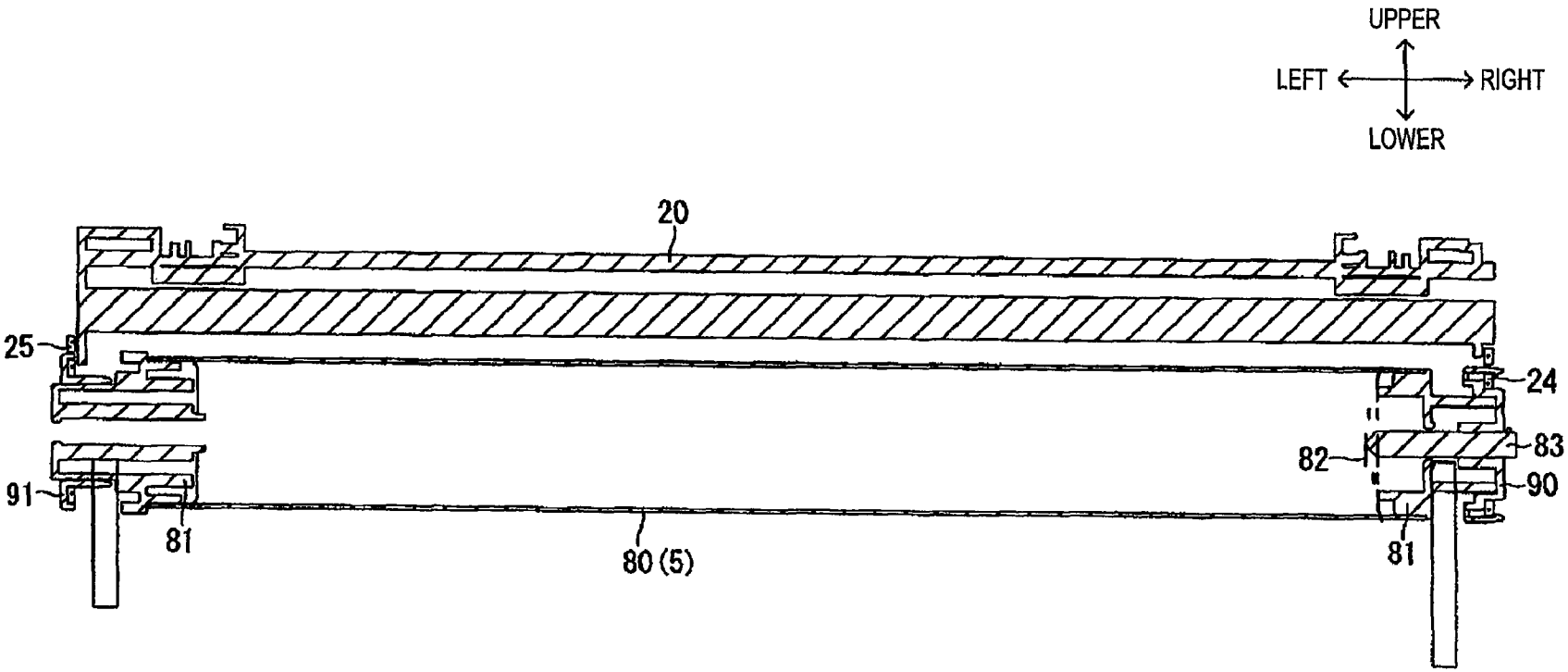
FIG. 6 is a sectional view of the drum unit shown in FIG. 3 taken along the line VI-VI.

As shown in FIG. 6, each photosensitive drum 5 includes a cylindrical drum main body 80, and two flange members 81 engaged with both end portions of the drum main body 80 so as to be non-rotatable in relation to each other, respectively.

The outermost layer of the drum main body 80 is formed by a positively chargeable photosensitive layer.

An earth member 82 and a shaft 83 are arranged at a right end portion in the drum main body 80.

Figure 7:
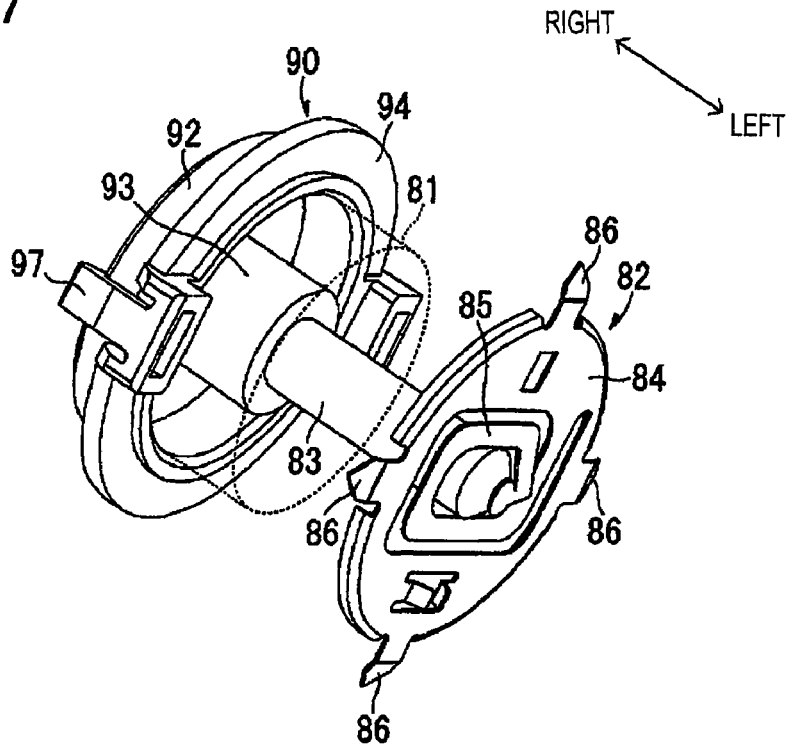
FIG. 7 is a perspective view of a part of the photosensitive drum, and a first bearing member.

The earth member 82 is made of metal, such as phosphor bronze or the like. As shown in FIG. 7, the earth member 82 includes a main body portion 84 in the form of an annular plate extending along the radial direction of the drum main body 80, and an elastic portion 85 provided in the main body portion 84.

Four claws 86 are arranged at a regular angular interval at the outer peripheral edge of the main body portion 84. The claws 85 come into contact with the inner surface of the drum main body 80.

One end of the elastic portion 85 is connected to the main body portion 84, and the other end of the elastic portion 85 extends in a spiral shape toward the central axis of the drum main body 80.

The shaft 83 is made of metal and is provided on the central axis of the drum main body 80. As shown in FIG. 6, the right end portion of the shaft 83 passes through the flange member 81 (described below) and protrudes rightward from the flange member 81. The left end portion of the shaft 83 is inserted into the spiral center of the elastic portion 85 and is in contact with the elastic portion 85.

The flange member 81 is made of resin and is partially inserted into each of both end portions of the drum main body 80. A coupling groove (not shown) to which a driving transmission part 105 (described below, see FIG. 2) provided in the main body casing 2 is coupled is provided at the left end surface of the left flange member 81. With this configuration, as shown in FIG. 1, in a state where the drum unit 4 is mounted in the main body casing 2, a driving force from the driving transmission part is transmitted to the photosensitive drums 5 to rotate the photosensitive drums 5. The flange member 81 has an outer diameter smaller than the diameter of each drum support hole 32 formed in the first inner side plate 24 and the second inner side plate 25.

The right side flange member 81 is supported to be rotatable with respect to the first inner side plate 24 by a first bearing member 90. The right flange member 81 is supported to be rotatable with respect to the second inner side plate 25 by a second bearing member 91.

(7) Bearing Member (7-1) First Bearing Member

Figure 8:
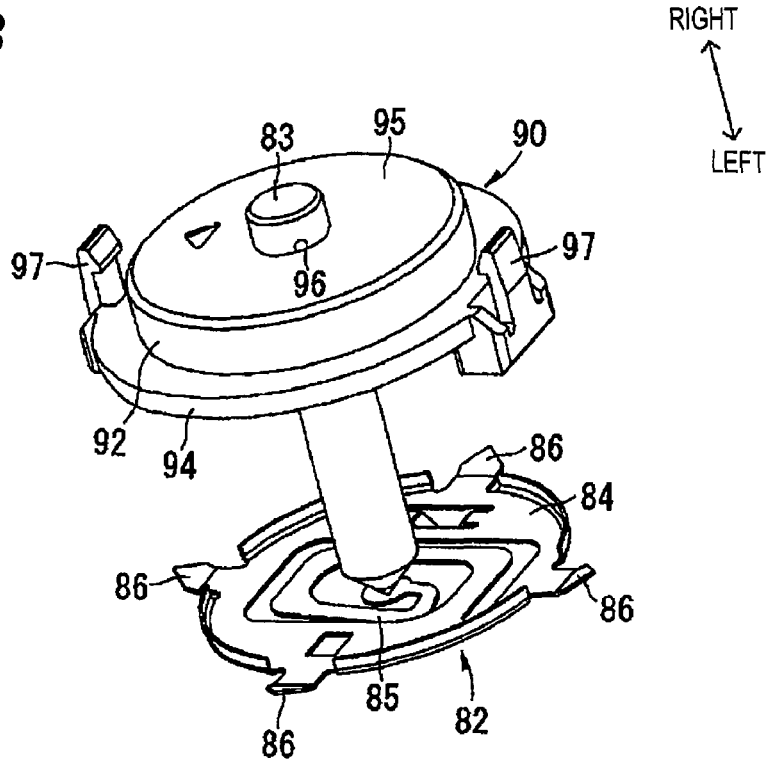
FIG. 8 is a perspective view showing a part of the photosensitive drum, and the first bearing member.

The first bearing member 90 is made of resin. As shown in FIGS. 7 and 8, the first bearing member 90 includes a cylindrical portion 92 (an example of a flange support portion or a first insertion portion), a shaft support portion 93 extending in the same direction as the cylindrical portion 92 inside the cylindrical portion 92, and a first flange portion 94 having an annular plate spreading outward from the left peripheral edge of the cylindrical portion 92.

The cylindrical portion 92 has an outer diameter slightly larger than the inner peripheral surface of each drum support hole 32 (see FIG. 4) formed in the first inner side plate 24, and has an inner diameter slightly larger than the outer peripheral surface of the right flange member 81. A seal portion 95 is formed integrally with the cylindrical portion 92 at the right end surface of the cylindrical portion 92 so as to seal the right end portion of the cylindrical portion 92. A shaft through hole 96 is formed at the center of the seal portion 95 and has the substantially same diameter of the outer peripheral surface of the shaft 83.

The shaft support portion 93 has the substantially same inner diameter as the outer peripheral surface of the shaft 83. The right end portion of the shaft support portion 93 is connected to a portion around the shaft through hole 96 at the left side surface of the seal portion 95. With this configuration, if the shaft 83 is supported in the shaft support portion 93 by pressing or integral molding, the right end portion of the shaft 83 protrudes rightward from the seal portion 95 (first bearing member 90) through the shaft through hole 96 of the seal portion 95.

At the outer peripheral edge of the first flange portion 94, engagement portions 97 (an example of a claw) protruding rightward from the first flange portion 94 are formed at opposing positions. The engagement portions 97 are formed such that the tip ends thereof are bent in a hook shape toward the center of the cylindrical portion 92.

(7-2) Second Bearing Member

Figure 9:
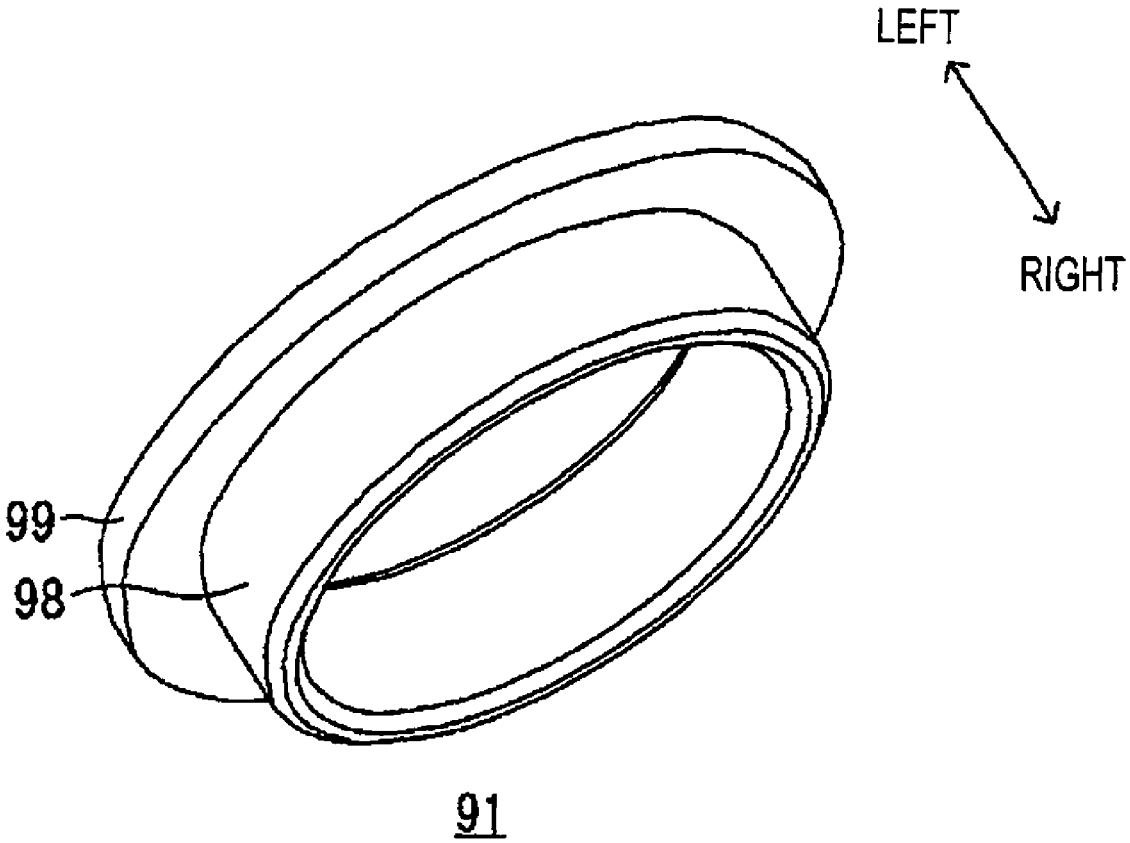
FIG. 9 is a perspective view of a second bearing member.

The second bearing member 91 is made of resin. As shown in FIG. 9, the second bearing member 91 includes, as a single body, a cylindrical portion 98 (an example of a second side support portion or a second insertion portion), and a second flange portion 99 having an annular plate spreading outward from the left peripheral edge of the cylindrical portion 98.

The cylindrical portion 98 has an outer diameter slightly larger than each drum support hole 32 (see FIG. 4) formed in the second inner side plate 25, and has an inner diameter slightly larger than the outer peripheral surface of the left flange member 81.

(8) Attachment of Photosensitive Drum to Drum Unit

Figure 10:
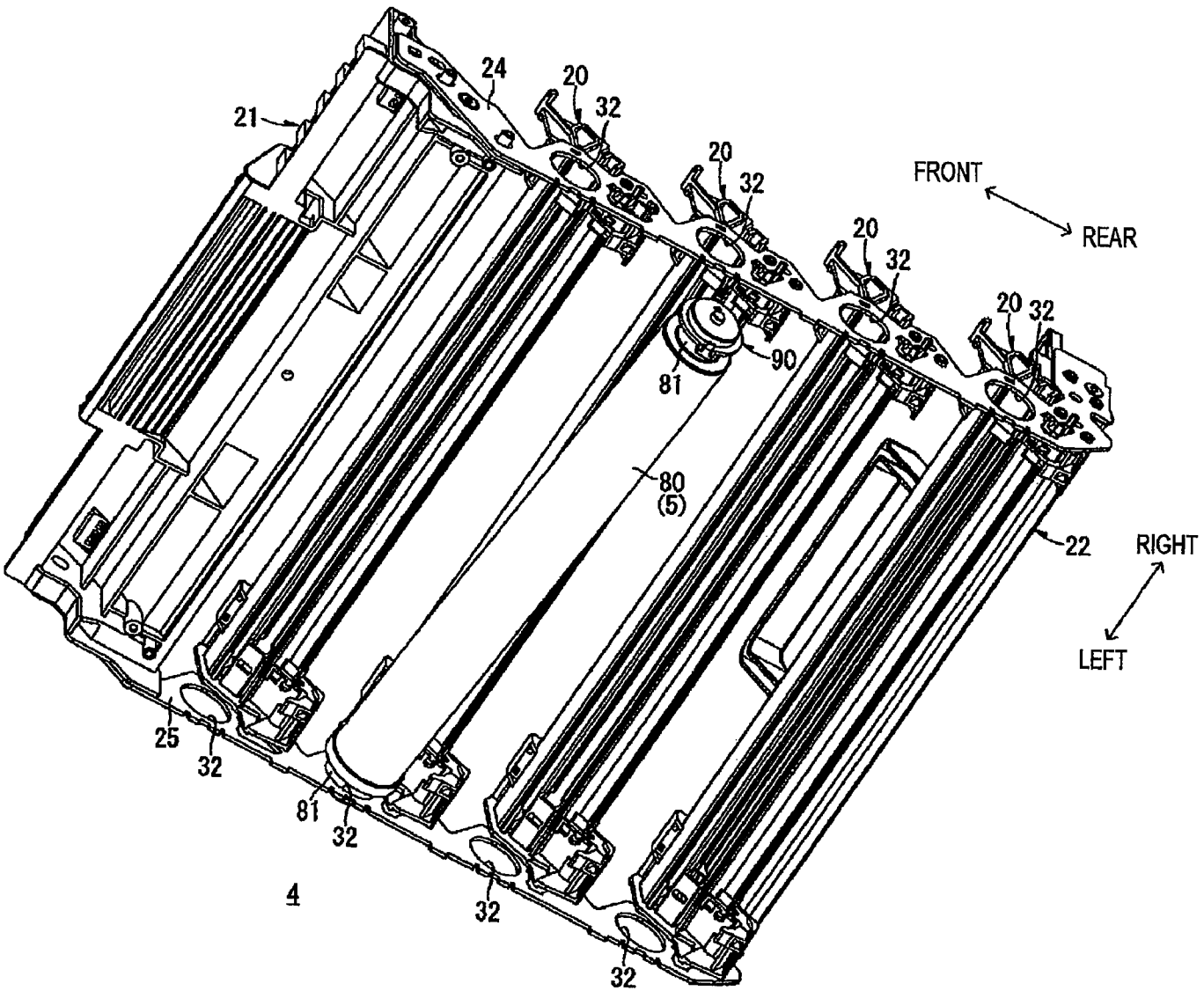
FIG. 10 is a perspective view of a drum unit when viewed from below the left front side, wherein while one photosensitive drum is being attached to the drum unit, the left end portion of the photosensitive drum is inserted into the drum support hole of the second inner side plate.

The photosensitive drums 5 are attached to the drum unit 4 in a state where the four drum subunits 20, the front beam 21, the rear beam 22, and the pair of first inner side plate 24 and second inner side plate 25 are assembled, as shown in FIG. 10.

Specifically, the four drum subunits 20 are first provided at a regular interval in the front-rear direction. Then, the front bean 21 is provided in front of the frontmost drum subunit 20 at an interval therefrom. The rear beam 22 is provided at the rear of the rearmost drum subunit 20 at a slight interval therefrom.

Thereafter, the first inner side plate 24 and the second inner side plate 25 are provided on the right and left sides of the front beam 21, the four drum subunits 20, and the rear beam 22. The first inner side plate 24 and the second inner side plate 25 are assembled with the front beam 21, the four drum subunits 20, and the rear beam 22 through a plurality of screws (not shown).

After the first inner side plate 24 and the second inner side plate 25 are assembled with the front beam 21, the four drum subunits 20, and the rear beam 22, the photosensitive drums 5 are attached. FIGS. 10 to 14 show only one of the photosensitive drums 5 for simplification.

As shown in FIG. 10, the first bearing member 90 is first mounted at the right end portion of the photosensitive drum 5. Specifically, as shown in FIG. 7, the right flange member 81 is inserted inside the cylindrical portion 92. The left end portion of the shaft 83 is in contact with the elastic portion 85 of the earth member 82.

Thereafter, the left end portion (left flange member 81) of the photosensitive drum 5 is inserted into the drum support hole 32 of the second inner side plate 25 obliquely from below. Specifically, the photosensitive drum 5 is inclined such that the left end portion thereof is directed relatively upward, and the right end portion thereof is directed relatively downward. The outer diameter of the flange member 81 is smaller than the diameter of the drum support hole 32, so the left flange member 81 is smoothly inserted into the drum support hole 32.

Figure 11:
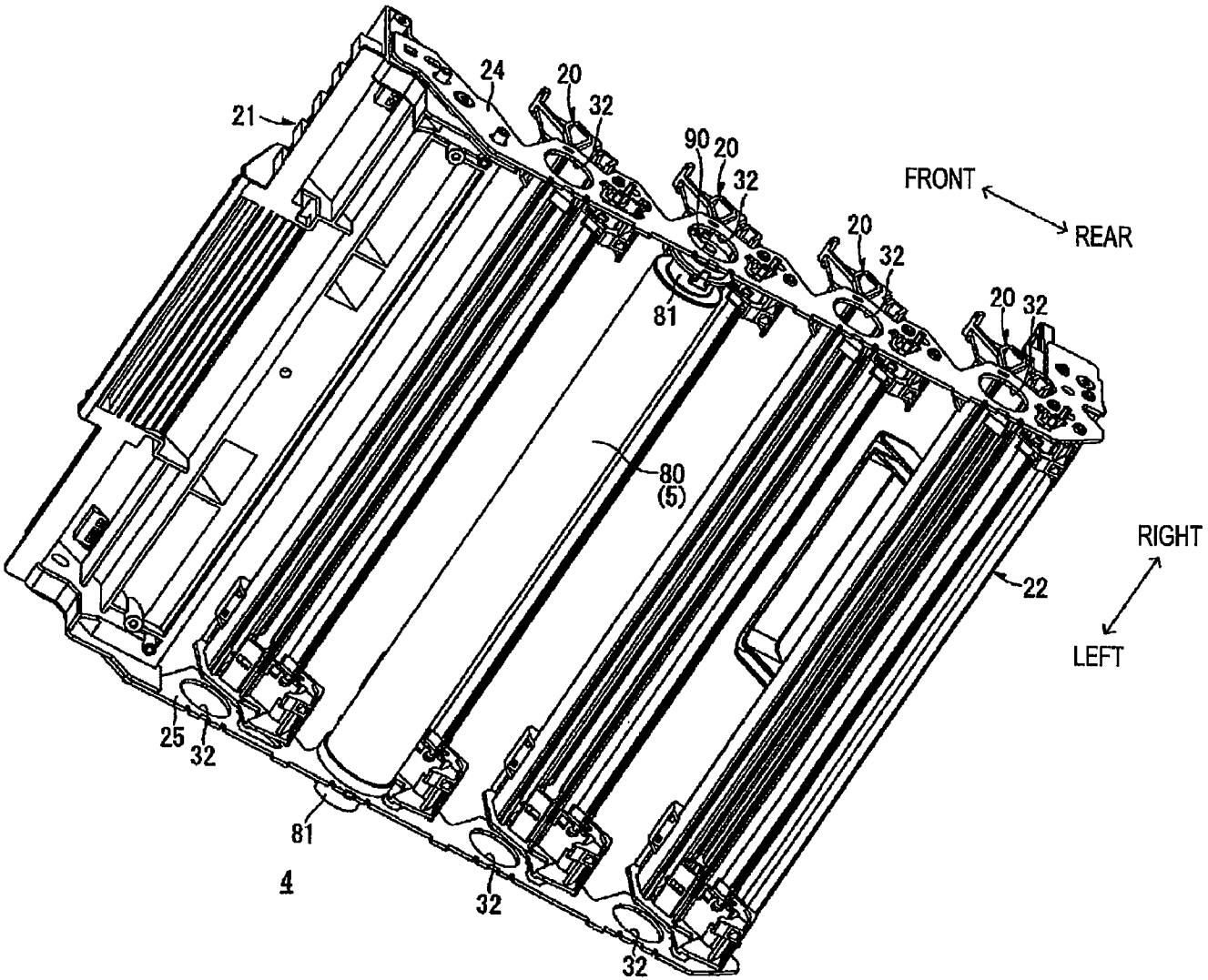
FIG. 11 is a perspective view of the drum unit when viewed from below the left front side, wherein while one photosensitive drum is being attached to the drum unit, the right end portion of the photosensitive drum is provided at a position opposing a drum support hole of a first inner side plate.

As shown in FIG. 11, in a state where the left flange member 81 is inserted into the drum support hole 32, the photosensitive drum 5 is positioned into parallel to the width direction. Specifically, the right end portion of the photosensitive drum 5 is arranged at a position opposing the drum support hole 32 of the first inner side plate 24 which opposes the drum support hole 32 of the second inner side plate 25 (the second drum support hole 32 from the front side in FIG. 11), into which the left end portion (left flange member 81) of the photosensitive drum 5 is inserted, in the width direction. Thus, the axial direction of the photosensitive drum 5 matches the width direction. In this state, the left flange member 81 is exposed leftward from the drum support hole 32 of the second inner side plate 25.

Figure 13:
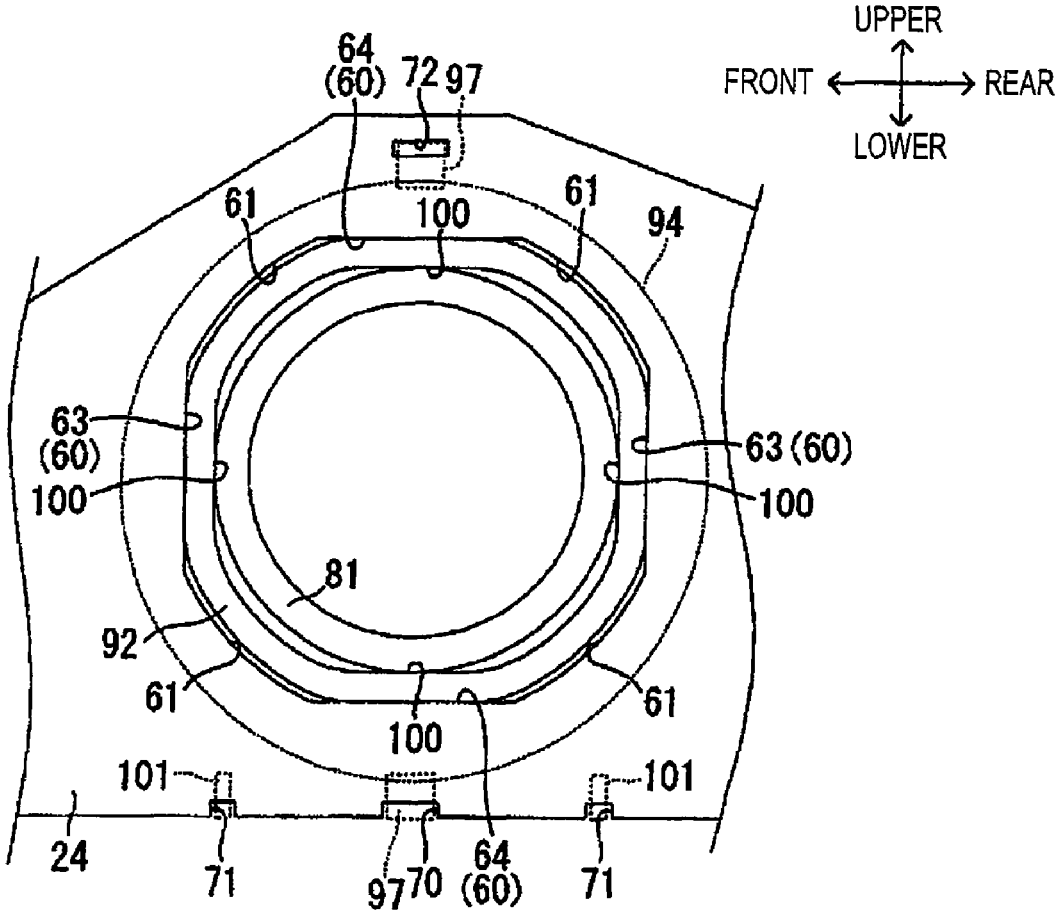
FIG. 13 is an enlarged sectional view of a portion around the drum support hole of the inner side plate, wherein a first bearing member is inserted into the drum support hole.

Next, the entire photosensitive drum 5 moves rightward, and the first bearing member 90 attached to the right end portion of the photosensitive drum 5 is fitted into the drum support hole 32 of the first inner side plate 24. Specifically, as shown in FIG. 13, the outer peripheral surface of the cylindrical portion 92 of the first bearing member 90 is deformed along the four linear portions 60 of the drum support hole 32 and then inserted into the drum support hole 32. In this state, an interval is formed between the outer peripheral surface of the cylindrical portion 92 and each curved portion 61. Four inner linear portions 100 are formed at the inner peripheral surface of the cylindrical portion 92 to be in parallel to the four linear portions 60 according to the deformation of the cylindrical portion 92. The right flange member 81 of the photosensitive drum 5 supported in the cylindrical portion 92 comes into contact with and is rotatably supported by any of the four inner linear portions 100. Thus, the right end portion of the photosensitive drum 5 is positioned.

In this state, the first flange portion 94 of the first bearing member 90 comes into contact with the inner side surface (left side surface) of the first inner side plate 24. The two engagement portions 97 of the first flange portion 94 are respectively engaged with the first bearing engagement groove 70 and the second bearing engagement hole 72 of the first inner side plate 24.

Figure 12:
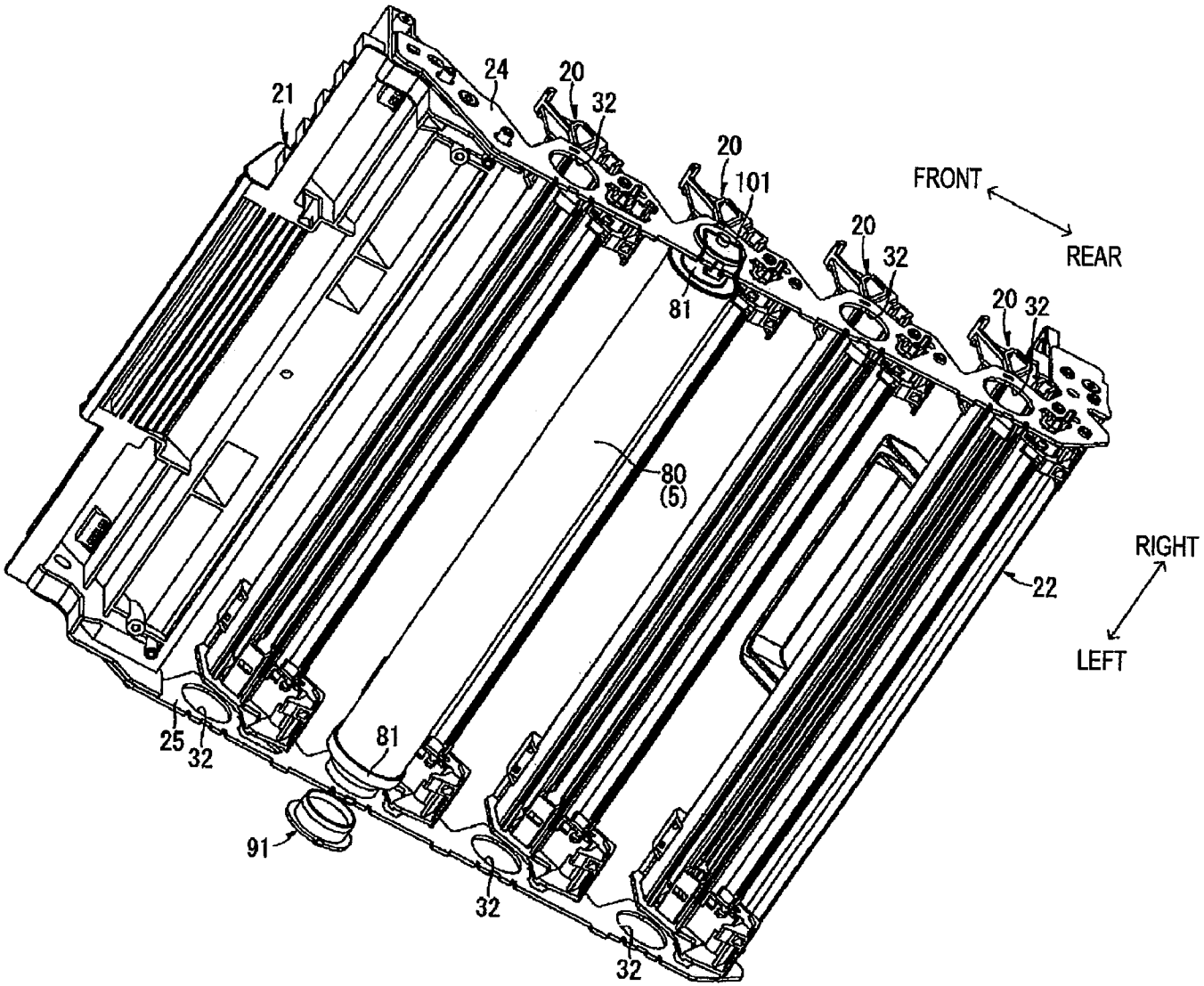
FIG. 12 is a perspective view of the drum unit when viewed from below the left front side, wherein while one photosensitive drum is being attached to the drum unit, the left end portion of the photosensitive drum is positioned on the second inner side plate.

Thereafter, as shown in FIG. 12, the second bearing member 91 is mounted to the second inner side plate 25 and the left end portion (left flange member 81) of the photosensitive drum 5. Specifically, the cylindrical portion 98 (see FIG. 9) of the second bearing member 91 is inserted between the outer peripheral surface of the flange member 81 exposed through the drum support hole 32 of the second inner side plate 25 and the drum support hole 32. That is, similarly to the first bearing member 90, the outer peripheral surface of the cylindrical portion 98 of the second bearing member 91 is deformed along the four linear portions 60 of the drum support hole 32 and inserted into the drum support hole 32. In this state, an interval is formed between the outer peripheral surface of the cylindrical portion 98 and each of the curved portions 61. Four inner linear portions are formed at the inner peripheral surface of the cylindrical portion 98 to be in parallel to the four linear portions 60 according to the deformation of the cylindrical portion 98. The left flange member 81 of the photosensitive drum 5 supported in the cylindrical portion 98 comes into contact with and is rotatably supported by any of the four inner linear portions. In this state, the second flange portion 99 of the second bearing member 91 comes into contact with the outer side surface (left side surface) of the second inner side plate 25. With this configuration, the left end portion of the photosensitive drum 5 is positioned.

Then, a clip member 101 is attached to a portion of the shaft 83 protruding leftward from the seal portion 95 (see FIG. 8) of the first bearing member 90. The clip member 101 is substantially U-shaped. As shown in FIG. 13, the free end portions of the clip member 101 are bent and respectively engaged with the clip engagement grooves 71 of the first inner side plate 90. Accordingly, the photosensitive drum 5 is attached to the drum unit 4.

Figure 14:
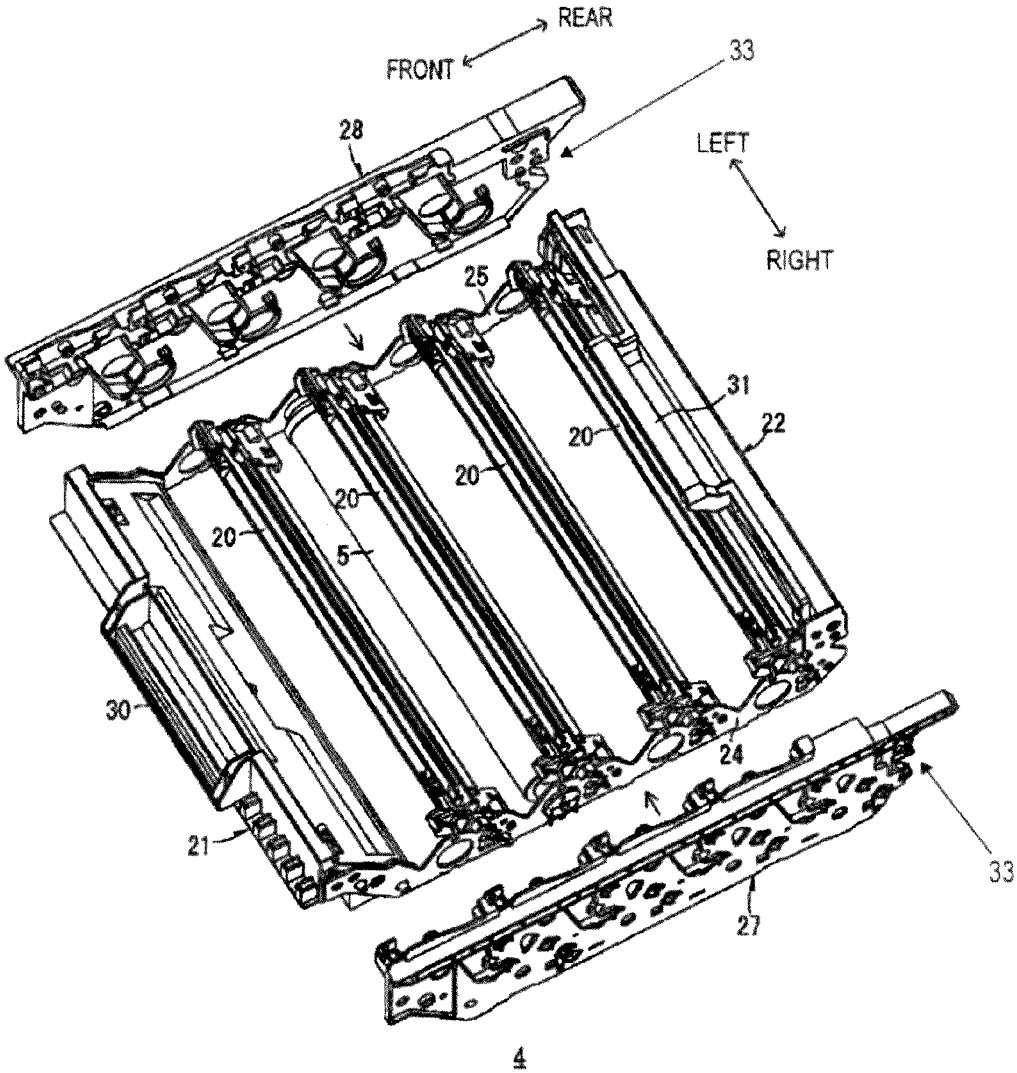
FIG. 14 is a perspective view of the drum unit when viewed from above the right front side, wherein the pair of outer side plates is being attached.

After the four photosensitive drums 5 are attached, as shown in FIG. 14, the outer side plates 26 are provided outside the inner side plates 23 in the width direction. Then, the first outer side plate 27 and the second outer side plate 28 are assembled with the first inner side plate 24 and the second inner side plate 25, the front beam 21, the four drum subunits 20, and the rear beam 22 through screws (not shown). Thus, the drum unit 4 is assembled.

3. Earth of Photosensitive Drum

As shown in FIG. 6, each photosensitive drum 5 includes the earth member 82 and the shaft 83. As described above, the claws 86 of the earth member 82 are in contact with the inner surface of the drum main body 80 of the photosensitive drum 5, and the earth member 82 and the shaft 83 come into contact with each other. Thus, the photosensitive drum 5 and the shaft 83 are electrically connected to each other. As shown in FIG. 12, the clip member 101 is attached to the right end portion of the shaft 83. The free end portions of the clip member 101 are respectively engaged with the clip engagement grooves 71 of the first inner side plate 24, so the shaft 83 and the first inner side plate 24 are electrically connected to each other. That is, the drum main body 80 of the photosensitive drum 5 is connected to the first inner side plate 24 through the earth member 82, the shaft 83, and the clip member 101 in an electrically conductible manner.

As shown in FIG. 1, in a state where the drum unit 4 is mounted in the main body casing 2, the main body reference shaft 34 enters the notched portions 53 (see FIG. 4) of the first inner side plate 24 and the second inner side plate 25, so the first inner side plate 24 and the second inner side plate 25 can be earthed through the main body reference shaft 34. The first inner side plate 24 and the photosensitive drum 5 are electrically connected with each other through the earth member 82, the shaft 83, and the clip member 101. Therefore, the photosensitive drum 5 can be earthed through the earth member 82, the shaft 83, the clip member 101, the first inner side plate 24, and the main body reference shaft 34.

4. Main Body Casing (1) Mount and Detachment of Drum Unit with Respect to Main Body Casing Referring to FIG. 1, when the drum unit 4 is mounted in the main body casing 2, the front cover 3 of the main body casing 2 is opened. Then, the drum unit 4 is moved rearward and then guided into the main body casing 2. If the notched portions 53 (see FIG. 4) of the first inner side plate 24 and the second inner side plate 25 come into contact with the main body reference shaft 34, the drum unit 4 is prohibited from further movement. Thus, the drum unit 4 is mounted in the main body casing 2.

The drum unit 4 is detached from the main body casing 2 by an operation reverse to the above-described operation.

(2) Input of Driving Force to Photosensitive Drum

As shown in FIG. 2, in a state where the drum unit 4 is mounted in the main body casing 2, the driving transmission part 105 (an example of a pressing member) for transmitting a driving force to the photosensitive drum is arranged at a position opposing the left end portion of the photosensitive drum 5 in the width direction. After the drum unit 4 is mounted in the main body casing 2, each driving transmission part 105 is advanced rightward and connected to the coupling groove (not shown) provided at the left end surface of the corresponding left flange member 81. Thus, the driving force can be transmitted from each driving transmission part 105 to the corresponding photosensitive drum 5 to rotate the corresponding photosensitive drum 5.

After each driving transmission part 105 is connected to the coupling groove of the corresponding flange member 81, the driving transmission part 105 is further advanced rightward. Then, the entire drum unit 4 moves rightward through the respective flange members 81. Thus, the drum unit 4 is positioned in the width direction. At this time, the force received by the photosensitive drum 5 (drum unit 4) from the corresponding driving transmission part 105 is larger than the force received by the shaft 83 from the earth member 82 shown in FIG. 7.

5. Advantages

As described above, the drum support holes 32 are respectively formed at the opposing positions of the first inner side plate 24 and the second inner side plate 25 of the drum unit 4. The first shaft receiving member 90 and the second shaft receiving member 91 are fitted into the drum support holes 32. The right end portion of each of the four photosensitive drums 5 is supported by the first inner side plate 24 through the first shaft receiving member 90, and the right end portion of each of the photosensitive drums 5 is supported by the second inner side plate 25 through the second shaft receiving member 91. The inner surface of each of the drum support holes 32 has the four linear portions 60. The four linear portions 60 are in contact with the virtual circle 62 virtually set in the drum support hole 32 and arranged at a regular angular interval with respect to the center of the virtual circle 62. That is, the drum support hole 32 is formed to have a substantially rectangular shape having the four linear portions 60. The first shaft receiving member 90 and the second shaft receiving member 91 respectively have the cylindrical portion 92 and the cylindrical portion 98 which are inserted into the drum support holes 32. Each of the cylindrical portion 92 and the cylindrical portion 98 has an outer peripheral surface having a diameter larger than the diameter of the virtual circle 62 virtually set in the drum support hole 32.

If the cylindrical portions 92 and 98 are respectively inserted into the drum support holes 32, the outer peripheral surfaces of the cylindrical portions 92 and 98 are deformed along the four linear portions 60, and the outer peripheral surfaces of the cylindrical portions 92 and 98 come into press contact with the linear portions 60 of the drum support hole 32. Therefore, the first shaft receiving member 90 and the second shaft receiving member 91 can be fitted into the drum support holes 32 with no backlash.

When a change in temperature occurs in the drum unit 4, and stress due to a difference in the amount of expansion between the first shaft receiving members 90 and the first inner side plate 24 and between the second shaft receiving member 91 and the second inner side plate 25 is applied to the first shaft receiving member 90 and the second shaft receiving member 91, portions other than the portions of first shaft receiving member 90 and the second shaft receiving member 91 in contact with the cylindrical portions 92 and 98 and the linear portions 60 are deformed, such that stress can be absorbed. Therefore, the first shaft receiving member 90 and the second shaft receiving member 91 can be prevented from being damaged.

The four inner linear portions 100 are formed at the respective inner surfaces of the cylindrical portions 92 and 98 to be parallel to the four linear portions 60 according to the deformation of the cylindrical portions 92 and 98. Both end portions of the photosensitive drum 5 supported by the cylindrical portions 92 and 98 come into contact with and are supported by any of the four inner linear portions 100. Therefore, both ends of the photosensitive drum 5 can be positioned with high accuracy.

The inner surface of each of the drum support holes 32 includes the four curved portions 61. Each of the curved portions 61 connects two linear portions 60 orthogonal to each other and is swollen outward in the diameter direction of the virtual circle 62. Thus, in the drum support hole 32, spaces are formed between the first and second shaft receiving members 90 and 91 and the four curved portions 61. Accordingly, when the first shaft receiving member 90 and the second shaft receiving member 91 are deformed outward in the diameter direction of the virtual circle 62, the deformation can be permitted within the spaces. Therefore, the first shaft receiving member 90 and the second shaft receiving member 91 can be further prevented from being damaged.

The four linear portions 60 include the two horizontal linear portions 64 extending in the front-rear direction and the two vertical linear portions 63 extending in the upper-lower direction.

Therefore, in each of the drum support holes 32, the vertical linear portions 63 on one side in the front-rear direction of the photosensitive drum 5 are formed at a regular interval, in the front-rear direction, so the four drum support holes 32 can be formed at a regular interval in the front-rear direction. Accordingly, the pitch between the photosensitive drums 5 supported in the respective drum support holes 32 through the first shaft receiving member 90 and the second shaft receiving member 91 can be constant.

The two horizontal linear portions 60 of each of the drum support holes 32 are formed on two lines extending in the front-back direction, so the four drum support holes 32 can be formed at the same positions in the upper-lower direction. Therefore, the photosensitive drums 5 supported in the respective drum support holes 32 through the first shaft receiving member 90 and the second shaft receiving member 91 can be arranged at the same positions in the upper-lower direction.

The first inner side plate 24 and the second inner side plate 25 are made of metal and formed by press-working with the same press die. Accordingly, the drum support holes 32 of the first inner side plate 24 and the second inner side plate 25 can be formed with the same accuracy. Further, it is not necessary to individually prepare a press die for the first inner side plate 24 and a press die for the second inner side plate 25, so working costs for the first inner side plate 24 and the second inner side plate 25 can be reduced.

The drum support holes 32 are formed by punching out the first inner side plate 24 and the second inner side plate 25 from the left sides. Thus, an angular portion between the inner surface of each of the drum support holes 32 of the first inner side plate 24 and the inner side surface (left side surface) of the first inner side plate 24 is curved and has a so-called sag surface. Therefore, the first bearing member 90 can be smoothly fitted into the drum support hole 32 from the inner side surface of the first inner side plate 24. An angular portion between the inner surface of each of the drum support holes 32 of the second inner side plate 25 and the outer side surface (left side surface) of the second inner side plate 25 is curved and has a so-called sag surface. Therefore, the second bearing member 91 can be smoothly fitted into the drum support hole 32 from the outer side surface of the second inner side plate 25.

The first inner side plate 24 and the second inner side plate 25 have the notched portions 53 for positioning the drum unit 4 with respect to the main body casing 2. The notched portions 53 come into contact with the main body reference shaft 34 in the main body casing 2 when the drum unit 4 is mounted in the main body casing 2. Therefore, in a state where the drum unit 4 is mounted in the main body casing 2, the drum unit 4 can be positioned with respect to the main body casing 2.

Further, the first bearing member 90 has the first flange portion 94 which is into contact with the inner side surface of the first inner side plate 24. The second bearing member 91 has the second flange portion 99 which is into contact with the outer side surface of the second inner side plate 25.

Thus, the first bearing member 90 is attached to one end portion of the photosensitive drum 5, and the first bearing member 90 is fitted into the drum support hole 32 of the first inner side plate 24. Thereafter, the second bearing member 91 is fitted into the drum support hole 32 of the second inner side plate 25, and the other end portion of the photosensitive drum 5 is supported in the second bearing member 91. Accordingly, the photosensitive drum 5 is attached to the first inner side plate 24 and the second inner side plate 25.

When the second bearing member 91 is detached from the drum support hole 32 of the second inner side plate 25, the other end portion of the photosensitive drum 5 is released. Thus, the photosensitive drum 5 and the first bearing member 90 are integrally detached from the drum support hole 32 of the first inner side plate 24. Accordingly, in order to replace one photosensitive drum 5, it is not necessary to release the state where the remaining photosensitive drums 5 are supported by the first inner side plate 24 and the second inner side plate 25. Therefore, the photosensitive drum 5 can be easily replaced.

The earth member 82 is provided in the drum main body 80 of the photosensitive drum 5. The shaft 83 is provided on the central axis of the photosensitive drum 5. The shaft 83 passes through the flange member 81, such that the right end portion thereof protrudes rightward from the flange member 81, and the left end portion thereof comes into contact with the earth member 82. Thus, the drum main body 80 of the photosensitive drum 5 can be earthed through the earth member 82 and the shaft 83.

The first bearing member 90 has the engagement portions 97. The engagement portions 97 are engaged with the first bearing engagement groove 70 and the second bearing engagement hole 72 of the first inner side plate 24. Thus, the first bearing member 90 is fixed in a state where the first inner side plate 24 is interposed by the first flange portion 94 and the engagement portions 97. Accordingly, the first bearing member 90 can be prevented from dropping from the drum support hole 32.

The driving transmission part 105 presses the corresponding photosensitive drum 5 from the left side toward the right side. The force received by the photosensitive drum 5 from the driving transmission part 105 is larger than the force received by the shaft 83 from the earth member 82.

The direction in which the photosensitive drum 5 is pressed by the corresponding driving transmission part 105 is identical to the direction in which the first flange portion 94 of the first bearing member 90 comes into contact with the inner side surface of the first inner side plate 24, and the direction in which the second flange portion 99 of the second bearing member 91 comes into contact with the outer side surface of the second inner side plate 25. Therefore, if the photosensitive drum 5 is pressed by the corresponding driving transmission part 105, the first bearing member 90 and the second bearing member 91 are respectively pressed against the first inner side plate 24 and the second inner side plate 25 through the photosensitive drum 5. Thus, there is no case where the first bearing member 90 and the second bearing member 91 are respectively inclined with respect to the first inner side plate 24 and the second inner side plate 25. Therefore, the photosensitive drum 5 can be stably supported.

What is claimed is:

1. A tandem type photosensitive unit comprising:

a plurality of photosensitive drums provided in parallel with each other;

first and second side plates provided on a first side and a second side of the photosensitive drums in an axial direction of the photosensitive drums, respectively, so as to oppose each other, the first side plate being formed with a first through hole at a position opposing each photosensitive drum in the axial direction, the second side plate being formed with a second through hole at a position opposing each photosensitive drum in the axial direction;

a first bearing member fitted into each of the first through holes and supporting a first end portion of the corresponding photosensitive drum at the first side; and a second bearing member fitted into each of the second through holes and supporting a second end portion of the corresponding photosensitive drum at the second side, wherein an inner surface of each of the through holes has four linear portions, wherein the four linear portions are in contact with a virtual circle virtually set in the corresponding through hole, and arranged at a regular angular interval with respect to a center of the virtual circle, and wherein each of the first and second bearing members includes an insertion portion which has an outer peripheral surface having a diameter larger than that of the virtual circle, and is inserted into the corresponding through hole.

2. The tandem type photosensitive unit according to claim 1, wherein the inner surface of each of the through holes includes four curved portions, each of which connects two linear portions orthogonal to each other, and each of which is swollen outward in a radial direction of the virtual circle.

3. The tandem type photosensitive unit according to claim 1, wherein the four linear portions include two horizontal linear portions extending in an arrangement direction of the photosensitive drums, and two vertical linear portions extending in a direction orthogonal to the arrangement direction and the axial direction.

4. The tandem type photosensitive unit according to claim 3, wherein the vertical linear portions provided on one side of respective through holes in the arrangement direction are formed at a constant interval in the arrangement direction.

5. The tandem type photosensitive unit according to claim 3, wherein the two horizontal linear portions of the respective through holes are formed on two lines extending in the arrangement direction, respectively.

6. The tandem type photosensitive unit according to claim 1, wherein the first and second side plates are made of metal and formed by press-working with a same press die.

7. The tandem type photosensitive unit according to claim 1, further comprising:

a shaft provided on a central axis of each of the photosensitive drums, wherein each of the photosensitive drums includes:

a cylindrical drum main body;

a flange member engaged with an end portion of the drum main body at the first side; and an earth member provided in the drum main body, wherein the shaft passes through the flange member, such that a first end portion of the shaft at the first side protrudes from the flange member toward the first side, and a second end portion of the shaft at the second side comes into contact with the earth member, wherein the first bearing member includes:

a shaft support portion which supports the first end portion of the shaft;

a flange support portion which supports the flange member; and a first flange portion which comes into contact with an inner side surface of the first side plate, and wherein the second bearing member includes:

a second side support portion which supports the second end portion of the photosensitive drum at the second side; and a second flange portion which comes into contact with an outer side surface of the second side plate.

8. The tandem type photosensitive unit according to claim 7, wherein the first bearing member further includes a claw portion which is engaged with an outer side surface of the first side plate.

9. The tandem type photosensitive unit according to claim 7, wherein the first side plate and the second side plate are made of metal, and wherein the first through hole and the second through hole are press-worked into the first side plate and the second side plate with a same press die, respectively.

10. The tandem type photosensitive unit according to claim 9, wherein the first through hole and the second through hole are punched out of the first side plate and the second side plate from the second side, respectively.

11. An image forming apparatus comprising:

an apparatus main body; and the tandem type photosensitive unit according to claim 1 and detachably mounted in the apparatus main body.

12. The image forming apparatus according to claim 11, wherein each of the first and second side plates has a positioning portion which comes into contact with a predetermined portion in the apparatus main body so as to position the tandem type photosensitive unit with respect to the apparatus main body when the tandem type photosensitive unit is mounted in the apparatus main body.

13. A tandem type photosensitive unit comprising:

a plurality of photosensitive drums provided in parallel with each other;

a shaft provided on a central axis of each of the photosensitive drums;

a first side plate provided on a first side of the photosensitive drums in an axial direction of the photosensitive drums, the first side plate being formed with a first through hole at a position opposing each photosensitive drum in the axial direction;

a second side plate provided on a second side of the photosensitive drum in the axial direction so as to oppose the first side plate, the second side plate being formed with a second through hole at a position opposing each photosensitive drum in the axial direction;

a first bearing member fitted into the first through hole; and a second bearing member fitted into the second through hole, wherein each of the photosensitive drums includes:

a cylindrical drum main body;

a flange member engaged with an end portion of the drum main body at the first side; and an earth member provided in the drum main body, wherein the shaft passes through the flange member, such that a first end portion of the shaft at the first side protrudes from the flange member toward the first side, and a second end portion of the shaft at the second side comes into contact with the earth member, wherein the first bearing member includes:

a shaft support portion which supports the first end portion of the shaft;

a flange support portion which supports the flange member; and a first flange portion which comes into contact with an inner side surface of the first side plate; and a claw portion which is engaged with an outer side surface of the first side plate, and wherein the second bearing member includes:

a second side support portion which supports a second end portion of the photosensitive drum at the second side; and a second flange portion which comes into contact with an outer side surface of the second side plate.

14. The tandem type photosensitive unit according to claim 13, wherein the first side plate and the second side plate are made of metal, and wherein the first through hole and the second through hole are press-worked into the first side plate and the second side plate with a same press die, respectively.

15. The tandem type photosensitive unit according to claim 14, wherein the first through hole and the second through hole are punched out of the first side plate and the second side plate from the second side, respectively.

16. The tandem type photosensitive unit according to claim 13, wherein an inner surface of each of the first through hole and the second through hole has four linear portions, wherein the four linear portions are in contact with a virtual circle virtually set in the corresponding through hole, and are arranged at a regular angular interval with respect to a center of the virtual circle, wherein the first bearing member further includes a first insertion portion which has a diameter larger than that of the virtual circle, and is inserted into the first through hole, and wherein the second bearing member further includes a second insertion portion which has a diameter larger than the diameter of the virtual circle, and is inserted into the second through hole.

17. The tandem type photosensitive unit according to claim 16, wherein the inner surface of each of the first through hole and the second through hole includes four curved portions, each of which connects two linear portions orthogonal to each other, and each of which is swollen outward in a radial direction of the virtual circle.

18. The tandem type photosensitive unit according to claim 16, wherein the four linear portions include two horizontal linear portions extending in an arrangement direction of the photosensitive drums, and two vertical linear portions extending in a direction orthogonal to the arrangement direction and the axial direction.

19. An image forming apparatus comprising:

an apparatus main body; and the tandem type photosensitive unit configured to be detachably mounted in the apparatus main body, the tandem type photosensitive unit comprising:

a plurality of photosensitive drums provided in parallel with each other;

a shaft provided on a central axis of each of the photosensitive drums;

a first side plate provided on a first side of the photosensitive drums in an axial direction of the photosensitive drums, the first side plate being formed with a first through hole at a position opposing each photosensitive drum in the axial direction;

a second side plate provided on a second side of the photosensitive drum in the axial direction so as to oppose the first side plate, the second side plate being formed with a second through hole at a position opposing each photosensitive drum in the axial direction;

a first bearing member fitted into the first through hole;

a second bearing member fitted into the second through hole; and a pressing member which presses each photosensitive drum from the second side toward the first side, wherein each of the photosensitive drums includes:

a cylindrical drum main body;

a flange member engaged with an end portion of the drum main body at the first side; and an earth member provided in the drum main body, wherein the shaft passes through the flange member, such that a first end portion of the shaft at the first side protrudes from the flange member toward the first side, and a second end portion of the shaft at the second side comes into contact with the earth member, wherein a force received by the photosensitive drum from the pressing member is larger than a force received by the shaft from the earth member, wherein the first bearing member includes:

a shaft support portion which supports the first end portion of the shaft;

a flange support portion which supports the flange member; and a first flange portion which comes into contact with an inner side surface of the first side plate, wherein the second bearing member includes:

a second side support portion which supports a second end portion of the photosensitive drum at the second side; and a second flange portion which comes into contact with an outer side surface of the second side plate.

* * * * *

UNITED STATES PATENT AND TRADEMARK OFFICE

CERTIFICATE OF CORRECTION

PATENT NO. : 8,326,179 B2
APPLICATION NO. : 12/626019
DATED : December 4, 2012
INVENTOR(S) : Junichi Hashimoto It is certified that error appears in the above-identified patent and that said Letters Patent is hereby corrected as shown below:

On the Title page, under Other Publications:
Please insert a *RETURN* after "translation." and before "JP Office Action"

In the Claims

In Column 17, Claim 13, Line 8:
Please delete "ber; and" and replace with --ber;--

Signed and Sealed this
Fifteenth Day of October, 2013

Teresa Stanek Rea
*Deputy Director of the United States Patent and Trademark Office*